US006974921B2

(12) United States Patent
Jørgensen et al.

(10) Patent No.: US 6,974,921 B2
(45) Date of Patent: Dec. 13, 2005

(54) COMBINED ROLLER AND PUSH SWITCH ASSEMBLY

(75) Inventors: Martin Bondo Jørgensen, Vaerløse (DK); Søren Ravnkilde, Ballerup (DK); Karsten Videbaek, Roskilde (DK); Morten Bjørn Wagner, Virum (DK)

(73) Assignee: Sonion Roskilde A/S, Roskilde (DK)

( * ) Notice: Subject to any disclaimer, the term of this patent is extended or adjusted under 35 U.S.C. 154(b) by 54 days.

(21) Appl. No.: 10/791,735

(22) Filed: Mar. 4, 2004

(65) Prior Publication Data

US 2004/0173442 A1 Sep. 9, 2004

Related U.S. Application Data

(60) Provisional application No. 60/451,266, filed on Mar. 4, 2003.

(51) Int. Cl.[7] ..... H01H 19/20
(52) U.S. Cl. ..... 200/14; 200/4; 200/570
(58) Field of Search ..... 200/4, 11 R, 14, 200/17 R, 18, 11 TW, 570, 564, 566

(56) References Cited

U.S. PATENT DOCUMENTS 5,593,023 A * 1/1997 Kaizaki et al. ..... 200/570
5,613,600 A * 3/1997 Yokoji et al. ..... 200/564
5,711,415 A * 1/1998 Fukuda et al. ..... 200/570
5,886,310 A * 3/1999 Kataoka et al. ..... 200/14
6,218,635 B1 * 4/2001 Shigemoto et al. ..... 200/570
6,388,212 B1 * 5/2002 Ishihara et al. ..... 200/18
6,555,768 B2 * 4/2003 Deruginsky et al. ..... 200/4

FOREIGN PATENT DOCUMENTS

EP 0874382 A1 10/1998

OTHER PUBLICATIONS

Search Report.

* cited by examiner

*Primary Examiner*—Michael A. Friedhofer
(74) *Attorney, Agent, or Firm*—Harness, Dickey & Pierce, P.L.C.

(57) ABSTRACT

A combined roller and push switch assembly includes a substantially hollow wheel-like roller member being displaceable from an initial position to a displaced position. The combined roller and push switch assembly further includes a member for returning the roller member from the displaced position to the initial position, the returning member is a resilient member being at least partly encircled by the roller member, and a coding member for detecting rotation of the roller member in relation to an associated frame. In particular, the combined roller and push switch assembly further including a switch for indicating when the roller member is in the displaced position, the switch being at least partly encircled by the roller member.

11 Claims, 5 Drawing Sheets

COMBINED ROLLER AND PUSH SWITCH ASSEMBLY

This application claims benefit of Provisional No. 60/451,266 filed Mar. 4, 2003.

The present invention relates to a combined roller and push switch assembly, comprising a substantially hollow wheel-like roller member being displaceable from an initial position to a displaced position. In particular, the present invention relates to a combined roller and push switch assembly further comprising switching means for indicating when the roller member is in the displaced position, the switching means being at least partly encircled by the roller member.

BACKGROUND OF THE INVENTION

EP 0 874 382 discloses a rotary-operation type electronic component incorporating a push switch—see e.g. FIGS. 1 and 2. A revolving contact-points board 2, which functions as movable contact-points for the rotary encoder and the push switch, is attached on a fitting substrate 1—the fitting substrate 1 constituting fixed contact-points. The revolving contact-points board 2 is provided with a round operation knob 3 fixed on it for driving, and is held revolvable by a pillar shaft 4 inserted through a center hole 2A. The revolving contact-points board 2 is slidable in a horizontal direction too on the fitting substrate 1 in the front-rear direction, and is being pushed to the front by a push back spring 5. A pulse signal is generated in accordance with the revolution of the operation knob 3.

It is a drawback that the push back spring 5 is positioned external to the rotary member since it thereby occupies extra space in the front-rear direction. Thus the push back spring 5 affects the total size of the device in the front-rear direction.

In FIGS. 6 and 8 of EP 0 874 382 the function of the switch is described. FIG. 8 shows the "ON" state of the switch. The elastic contact-point 11 for switch slides on the bottom surface of revolving contact points board 2 to make contact with the ring contact-point 8. As a result, the common contact-point 12 and the contact-point 11 for switch are electrically coupled via ring contact-point 8 to make up a state of switch ON.

It is a further general drawback with the device described in EP 0 874 382 that the contact-points 11,12,13,14 slide on the bottom surface of revolving contact points board 2, see for example FIGS. 4, 6 and 8. The sliding contacts are used both for detecting a rotation of the operation knob 3 and for providing the switch function. This will generally involve rebound. Therefore, the switch function can not be considered a high quality switch since it will suffer from rebound in its "ON" state. If such switch is an active part of the signal path in audio equipment, such as hearing aids, it will cause audible noise and clicks.

In addition, the sliding contacts will suffer from poor long term stability and a poor reliability.

U.S. Pat. No. 5,711,415 discloses a rotary electronic component with a push switch, wherein a single control knob can individually operate a rotary component portion and a push switch. The rotary electronic component comprises a rotary component portion with a rotary body rotatable in a fixed position, a knob shaft, a control knob fitted concentrically around the outer periphery of the knob shaft, a resilient portion disposed between the knob shaft and the inner periphery of the control knob, and a push switch portion. The rotary component portion is actuated by rotation of the control knob while the push switch portion is actuated by the radial displacement of the control knob. In particular, the push switch is located outside the control knob, which complicates assembly of the rotary electronic component as the push switch has to be firmly fixed to an underlying support, e.g. a printed circuit board (PCB). This also limits the possibilities for miniaturisation of the component described in U.S. Pat. No. 5,711,415.

It may be seen as an object of the present invention to provide a combined roller and switch suited for applications with very limited space available. In addition, contact elements of the switch should not rotate together with the roller member in order to make the switch function free from rebounds thus reducing noise.

SUMMARY OF THE INVENTION

The objects are complied with by providing a combined roller and push switch assembly comprising a substantially hollow wheel-like roller member being supported by an associated frame and being rotatably mounted in relation to the associated frame. It is to be understood that the associated frame does not form part of the invention itself. The roller member is displaceable relative to the associated frame from an initial position to a displaced position. Means for returning the roller member from the displaced position to the initial position comprises a resilient member being at least partly encircled by the roller member. In addition, means for detecting rotation of the roller member in relation to the associated frame, and switching means for indicating when the roller member is in the displaced position are also provided. The switching means is at least partly encircled by the roller member.

The resilient member may be made of an elastic material, such as rubber. The resilient member may be formed as a ring having one or more protrusions extending in a radial direction away from a centre defined by the ring. The resilient member may have four protrusion. The resilient member may be mounted on a, in relation to the associated frame, rotatably mounted base member.

The switching means may comprises a contact disc adapted to provided electrical contact between at least two contact points within roller member when the roller member is in its displaced position, the contact disc being displaceable with the roller member. The switching means may further comprise a switch leg adapted to provide electrical contact with a corresponding hole in the contact disc when the roller member is in its displaced position, said switch leg being fixedly mounted relative to the associated frame.

The detection means may comprise a coding member being at least partly encircled in the roller member. The coding member may comprise a metal disc having between 5 and 25 holes arranged therein, the metal disc being positioned at least partly encircled by the roller member. The detection means may comprise an arrangement of an electrically conductive path arranged on a substantially plane surface, and an electrically conductive wiper having a first contact end being in contact with the electrically conductive path, the conductive wiper being arranged to rotate with the roller member whereby the first contact end is moved along the electrically conductive path upon rotation of the roller member. The detection means may comprise means for generating electric pulses according to a detected rotation of the roller.

BRIEF DESCRIPTION OF THE DRAWINGS

In the following the invention will be described in detail with reference to the accompanying figures of which

Figure 1:
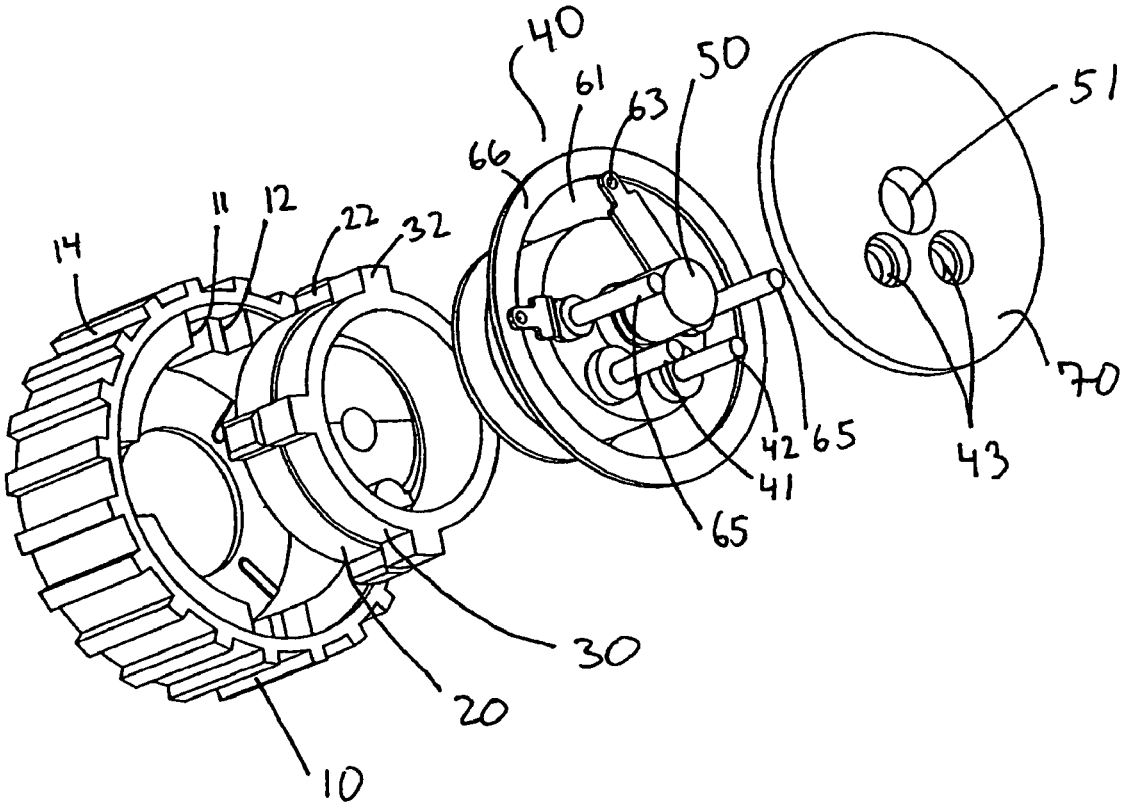
FIG. 1 shows an partly exploded view of the rotating parts of a roller arrangement according to a first embodiment.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

FIG. 1 shows, in an partly exploded view, a roller arrangement according to a preferred embodiment of the present invention. A wheel-like roller 10 with a hollow part serves as control knob being externally accessible to a user. The roller 10 has four recesses 11,12 equally spaced on an inner periphery of the roller, a deepness of the recesses 11 and the recesses 12 being different (not visible in FIG. 1). The recesses 12 towards an open part of the roller 10 are deeper than the recesses 11 towards a bottom part of the roller 10.

The hollow part of the roller 10 is adapted to receive a resilient member 20 being shaped as a ring. Four protrusions 22 on an outer periphery of the resilient member 20 extend in a radial direction away from a centre defined by the ring. The protrusions 22 are equally space along a periphery of the ring so as to fit tightly into the recesses 11 of the roller 10. Another ring shaped member 30 is adapted to fit tightly into the resilient member 20 by a flange 31 (not visible in FIG. 1 but visible in FIG. 2). The ring shaped member 30 has four equally spaced protrusions 32 on its outer periphery similar to the protrusions 22 on the resilient member 20, and the protrusions 32 are arranged in the same radial positions as the protrusions 22 of the resilient member 20. The recesses 12 of the roller 10 are adapted to receive the protrusions 32. When assembled, the protrusions 32 are not in contact with the recess 12. The roller 10 is fixed to the parts 20,30,40,50 only via the four protrusions 22 on the resilient member 20 being in contact with the four recesses 11 of the roller 10. When assembled the parts 10,20,30 are fixed together so as to follow rotational movements of the roller 10 when the roller 10 is rotated by a user's finger.

In FIG. 1 the roller 10 is shown with protrusions 14 on its outer periphery that facilitates the user's rotation of the roller 10 since the protrusions 14 serve to provide an adequate friction for the user's finger thus preventing the user's finger to slide when operating the roller 10.

The switch function is implemented by using the resilient properties of the resilient member 20. If the roller 10 is pushed on its outer periphery towards the centre it can be displaced a certain distance and thus activate a switch accordingly. This is implemented by the resilient protrusions 22 fixing the roller 10. When the roller 10 is pushed, one or two of the elastic protrusions 22, the one or two being close to the point of the roller 10 being pushed, are compressed. The compression of the protrusions 22 allows the roller 10 to be displaced. A spring effect due to the resilient properties of the protrusions 22 will cause the roller 10 to return from a displaced position to its initial not displaced, relax position, when a push force is removed.

The protrusions 32 of the ring shaped member 30 are not in contact with the recesses 12 of the roller 10 in a relaxed state, e.g. when the roller 10 is not pushed. This clearance between the protrusions 32 and the recesses 12 allows the resilient protrusions 22 to be compressed. When compressed to a certain displacement corresponding to the clearance the not resilient protrusions 32 and the recesses 12 will meet and a maximum possible displacement of the roller 10 is reached.

Resilient properties of the resilient material used for the resilient member 20 and the shape of its protrusions 22 will determine which push force is required to activate the switch. The required push force will also be determined from the chosen number of protrusions 22. It is possible to use three protrusions 22 only. The number of protrusions 22 may also be larger than four, such as 5, 6, 7, 8 or 9. In addition, the resilient properties will affect the roller's 10 ability to return to its initial position, e.g. returning from an activated to a deactivated state of the switch. Preferably, the resilient member is manufactured in an elastomeric material such as TPE.

The ring shaped member 30 has an inner diameter adapted to receive cylindrically shaped rotation detection means 40. The detection means 40 is mounted on an axle 50. The axle 50 serves the purpose of fixing the assembly by riveting. The axle 50 may be fixed to an associated frame (not shown) so as to allow the detection means 40 to detect a rotation of the roller 10 in relation to an external device. Integrated with the detection means 40 is a switch function for indicating when the roller 10 is in a displaced position. The switch function comprises a electrically conductive circular contact disc 66, the disc 66 being in permanent electrical contact with a first switching terminal 65. In this embodiment, the contact disc 66 is fixed to the roller 10 when assembled, and hence the contact disc 66 will rigidly follow the displacement and rotation of the roller 10. Contrary, the first switching terminal 65 will remain fixed independently of the displacement and rotation of the roller 10 while maintained electrical contact to the contact disc 66. The electrical contact between the contact disc 66 and the first switching terminal 65 can be via a wiper or similar. A second switch terminal 64 is connected to a switch leg 63 that is positioned inside a hole 61 inside the contact disc 60. The circular hole 61 is in this embodiment concentric with the contact disc 66. The second switch terminal 64 and the switch leg 63 will remain fixed independently of the displacement and rotation of the roller 10. In an initial position of the roller 10 the switch leg 63 is arranged relative to the contact disc 66 so as to avoid electrical contact between the switch leg 63 and the contact disc 66, and consequently there is also no electrical contact between the first switching terminal 65 and the second switching terminal 64 in the initial position. Upon sufficient radial displacement of the roller 10 the contact disc 66 will be radially displaced and brought into electrical contact with the switch leg 63, thus establishing electrical contact between the first switching terminal 65 and the second switching terminal 64 in a displaced position. The contact disc 66 and other conductive parts, e.g. the switching terminals 64 and 65, are preferably manufactured in a copper alloy.

Also shown in FIG. 1 is a rear plate 70 for closing the assembly. The rear plate 70 comprises holes. Only holes 43 adapted to fit detection terminals 41 and 42 and hole 51 adapted to fit the axle 50 are shown in this Figure.

Figure 2:
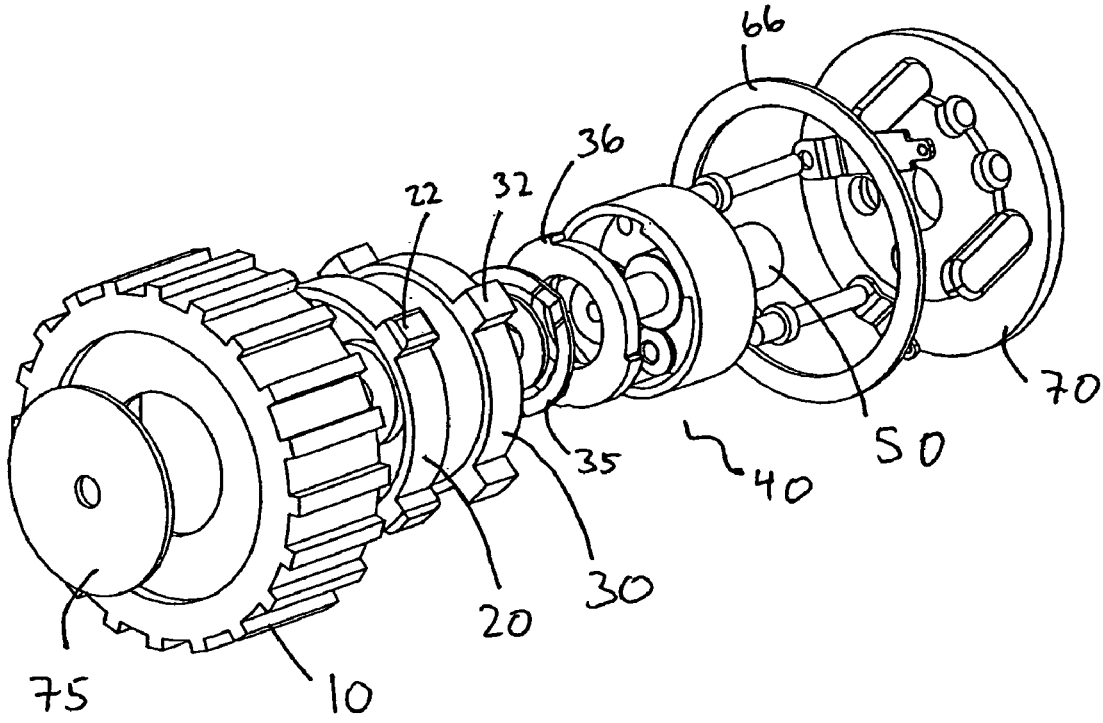
FIG. 2 shows an exploded view of the same roller arrangement.

FIG. 2 shows an exploded view of the same roller arrangement as in FIG. 1, the flange 31 of the ring shaped member 30 is now visible. A front plate 75 mounted on the axle 50 is adapted to keep the roller 10 in position.

In FIG. 2 a wiper 35 positioned inside the detection means 40 is shown. The detection means 40 detects a rotational movement or a rotational position by means of a potentiometer used to form an electrical voltage divider, the voltage division being dependent on the position of the contacting part of the wiper 35 on a conductive electrically conductive path arranged on a substantially plane surface 36. The wiper 35 is arranged to rotate with the roller 10, whereby the contacting part of the wiper 35 is moved along the electrically conductive path upon rotation of the roller 10. The axle 50 is manufactured in an electrically conductive material, and the axle 50 is in electrical contact with the wiper 35. The axle 50 together with detection terminals 41 and 42 (visible in FIG. 1) thereby constitute the three contact pins of the potentiometer. Such a potentiometer will normally allow a rotational freedom of for example 270°.

The detection means 40 may also detect rotational movement of the roller arrangement by means of an arrangement generating an electrical signal such as a pulse between two externally accessible terminals as the roller 10 is rotated either clockwise or counter clockwise. The last mentioned arrangement may allow the roller to be freely rotated in both directions without any stop. The detection may be in accordance with a gray code of a XYZ code as known by the skilled person. Implementations may be DCU 93 or CDU 254. Typically such embodiments of the detection means 40 comprise a disc with a number of holes, typically 3, 6, 9, 12, 15, 18, 21 or 24 holes are used.

Figure 3:
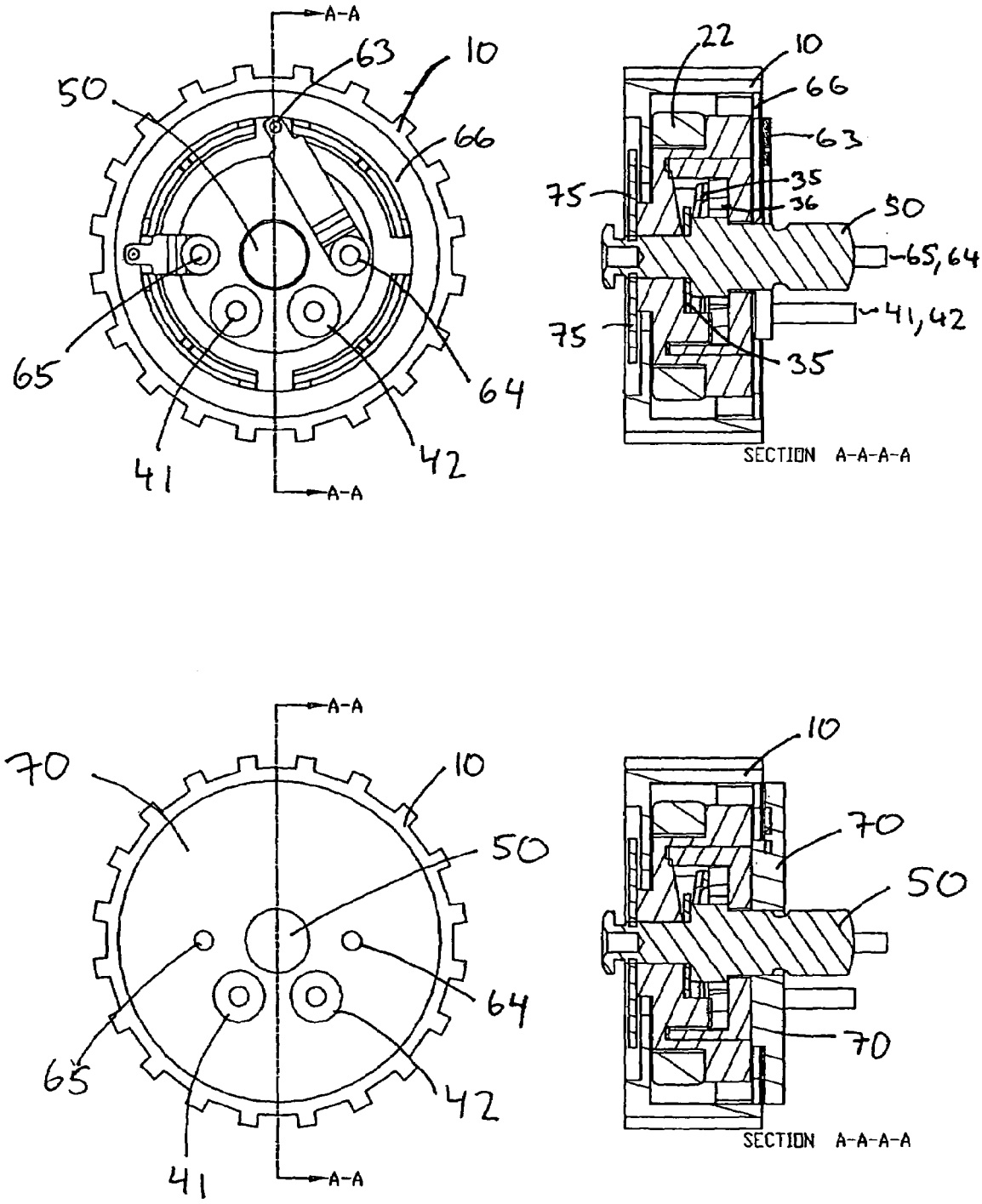
FIG. 3 shows back-side views and sectional views of the assembled roller arrangement of FIG. 1 and FIG. 2.

FIG. 3 shows back-side views and sectional views of the assembled roller arrangement shown in FIG. 1 and FIG. 2. In the upper part of FIG. 3, the rear plate 70 is not mounted, whereas the rear plate 70 is mounted on the roller arrangement in the lower part of FIG. 3.

In FIG. 3 upper part, the roller 10 is in the initial relaxed position of the roller 10 so there is not electrical connection between the contact disc 66 and the switch leg 63. The contact disc 60 is permanently in electrical contact with the first switching terminal 65 independently of the radial displacement of the roller 10. In the upper sectional view of FIG. 3, it is shown how the wiper 35 is in contact with the axle 50 and the planar surface 36. It is also shown how the switch leg 63 is positioned below the contact disc 66 (relative to the Figure). As the roller 10 is depressed downwards (relative to the Figure) the protrusion 22 of the resilient member 20 is compressed and electrical connection between the switch leg 63 and the contact disc 66 will be established. The shortest distance that the roller 10 has to be displaced to establish electrical connection between the contact disc 66 and the switch leg 63 is by a purely radial displacement of the roller 10 along the sectional line A—A; i.e. straight downwards in the Figure. The front plate 75 is dimensioned so as to keep the roller 10 in position, but the roller 10 may slide against the front plate 75 as the roller 10 is rotated and/or radially displaced.

In the lower part of FIG. 3, the rear plate 70 is mounted with the result that the interior of the roller assembly is sealed off, but by corresponding holes in the rear plate 70 the axle 50, the switching terminals 64 and 65, and the detection terminals 41 and 42 are allowed to penetrate through the rear plate 70 to facilitate mounting and electrical connection with the roller assembly.

Figure 4:
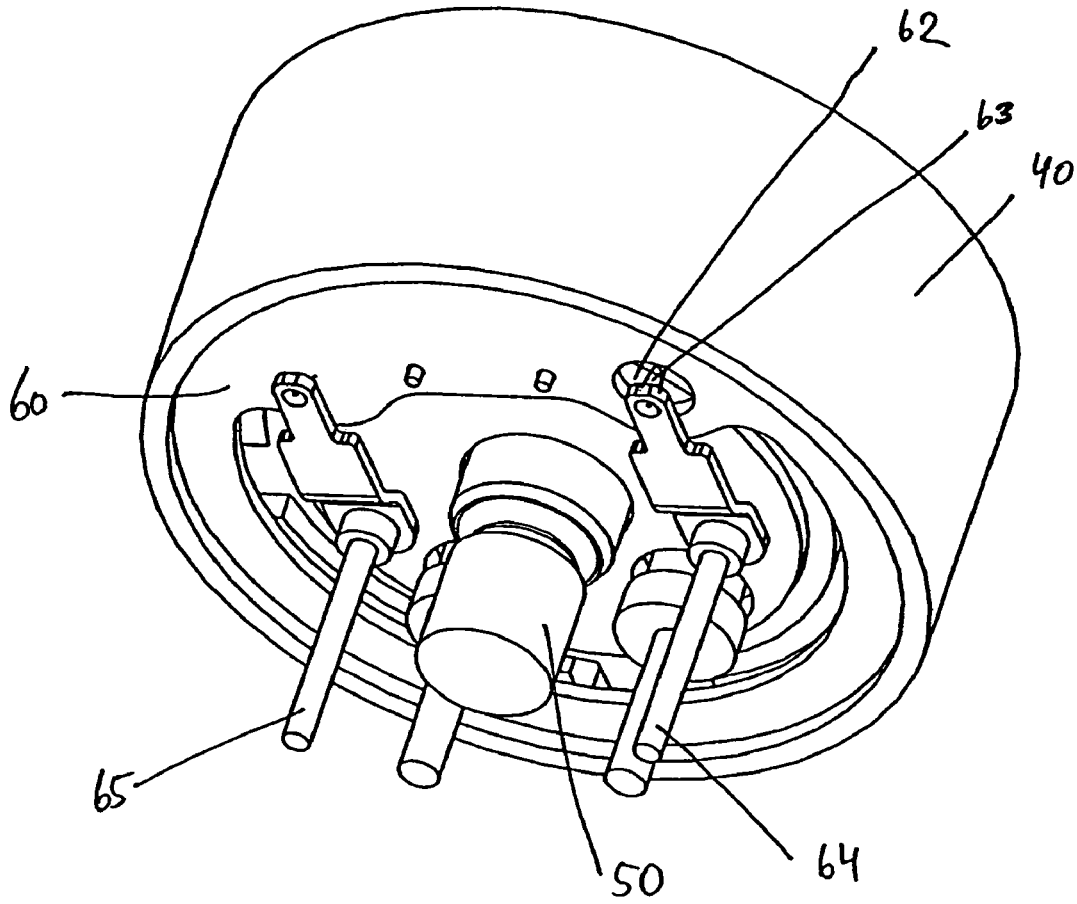
FIG. 4 shows detection means according to a second embodiment.

FIG. 4 shows part of another embodiment of the detection means 40 in which a switch function is integrated. A contact disc 60 is in permanent contact with a first switch terminal 65, the contact disc 60 is electrically conductive. A second switch terminal 64 is connected to a switch leg 63 positioned within a hole 62 in the contact disc 60. In FIG. 4 the switch arrangement is shown in an initial position in which the switch leg 63 is positioned substantially in the centre of the hole 62 in the contact disc 60. Therefore, there is no electrical connection between the switch leg 63 and the contact disc 60, and consequently there is not electrical connection between the first switch terminal 65 and the second switch terminal 64. In this embodiment the contact disc 60 does not rotate with the roller 10, but the contact disc 60 is radially displaceable with the roller 10 (not shown in this Figure).

Figure 5:
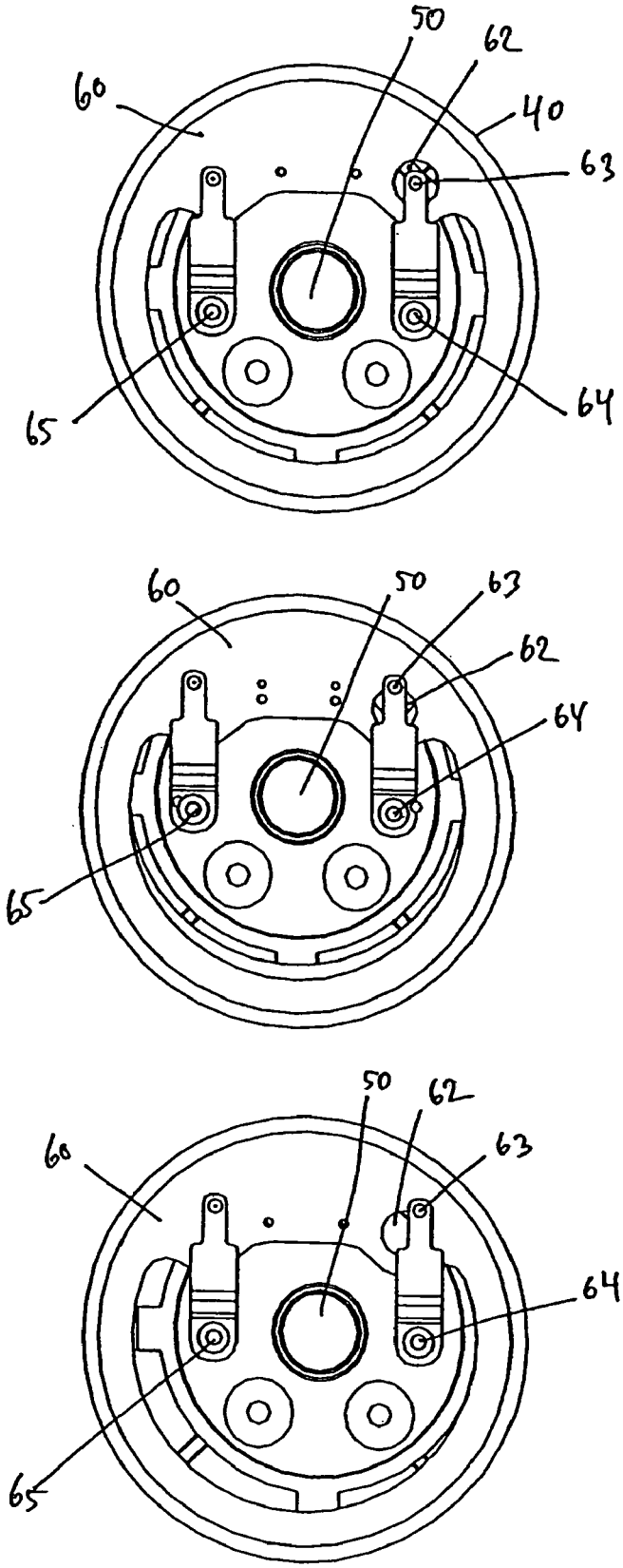
FIG. 5 shows detection means according to the second embodiment in an initial position, and two displaced positions.

FIG. 5 shows the switch embodiment of FIG. 4 in three states. Upper part of FIG. 5 shows the switch arrangement in an initial position. In the initial position the axle 50 is positioned substantially in the centre of the detection means 40, and the switch leg 63 is positioned substantially in the centre of the hole 62 in the contact disc 60. Hereby, the first switch terminal 65 is not in electrical contact with the second switch terminal 64.

Centre part of FIG. 5 shows the switch embodiment in a displaced position such as if, in a fully assembled roller and switch assembly, the roller 10 is pushed. It is seen in the centre part of FIG. 5 that the displacement has caused the switch leg 63 to be in contact with the contact disc 60 and thus causing an electrical connection between the first switch terminal 65 and the second switch terminal 64.

Bottom part of FIG. 5 shows the switch embodiment in another displaced position. Whereas the centre part of FIG. 5 shows a vertical, downward (relative to the figure) displacement of the contact disc 60, the bottom part of FIG. 5 shows a combined displacement to the left and downwards (relative to the figure) of the contact disc 60. As in the centre part the contact disc 60 is also displaced to a degree that the switch leg 63 is forced to an edge of the hole 62 and thereby in contact with the contact disc 60. Hereby an electrical connection is established between the first switch terminal 65 and the second switch terminal 64.

According to the switch embodiment shown in FIGS. 4 to 5 it is possible to establish an electrical contact between the first switch terminal 65 and the second switch terminal 64 by displacing the roller 10 in any radial direction. The resilient mounting of the roller 10 will cause the roller 10 to return to its initial position and thus cause the electrical connection to be disconnected when the roller is not forced into a displaced position.

For a hearing aid roller and switch arrangement a preferred maximum possible displacement of the roller 10 may be for example 0.4 mm. The roller 10 may have a diameter of 5–7 mm and a thickness of 2–3 mm. Preferably, the roller is manufactured in PA6.6 reinforced by 10–40% glass fibre. In a preferred embodiment, the protrusions 14 are located equidistantly on the roller's 10 circumference at an angular distance of approximate 18° (i.e. with a total of 20 protrusions), the width of the protrusions 14 being approximately 0.2–0.4 mm, preferably 0.3 mm. Other plastic part of the assembly are preferably manufactured in PEEK with approximately 30% glass fibre.

A combined roller and switch is well suited for integration into hearing aid, especially hearing aid devices of the BTE (Behind The Ear) type. A combined roller and switch may be integrated so that at least a part of the roller protrudes from a hole in an outer part of the hearing aid device, thus the roller being accessible for the user. The roller function may serve as volume control of the hearing aid. However, it may serve other purposes in other modes of operation of the hearing aid. For example the roller may be used for tuning parameters regarding tonal balance, focusing effect, compression rate, directivity or the like. The roller may function either by means of an analog potentiometer used as a variable voltage divider, or by means of a digital scan of rotation direction. In a hearing aid the switch function may serve a number of different purposes. It may be used to toggle between different operation modes of the hearing aid, such as different pre-selected preferred states regarding volume, focusing effect, compression etc. It may also be used for selection of different inputs such as the built-in microphone, an external wireless conference microphone, a wire loop system etc.

What is claimed is:

1. A combined roller and push switch assembly, comprising, a substantially hollow wheel-like roller member being supported by an associated frame and being rotatably mounted in relation to the associated frame, the roller member being displaceable relative to the associated frame so as to render the roller member displaceable in relation to the associated frame from an initial position to a displaced position, means for returning the roller member from the displaced position to the initial position, the returning means comprising a resilient member being at least partly encircled by the roller member, means for detecting rotation of the roller member in relation to the associated frame, and switching means for indicating when the roller member is in the displaced position, wherein the switching means is at least partly encircled by the roller member.

2. A roller and push switch assembly according to claim 1, wherein the resilient member is made of an elastic material.

3. A roller and push switch assembly according to claim 1, wherein the resilient member is formed as a ring having one or more protrusions extending in a radial direction away from a centre defined by the ring.

4. A roller and push switch assembly according to claim 3, wherein the resilient member has four protrusion.

5. A roller and push switch assembly according to claim 1, wherein the resilient member is mounted on a, in relation to the associated frame, rotatably mounted base member.

6. A roller and push switch assembly according to claim 1, wherein the switching means comprises a contact disc providing electrical contact between at least two contact points within the roller member when the roller member is in the displaced position, the contact disc being displaceable with the roller member.

7. A roller and push switch assembly according to claim 6 further comprising a switch leg providing electrical contact with a corresponding hole in the contact disc when the roller member is in the displaced position, said switch leg being fixedly mounted relative to the associated frame.

8. A roller and push switch assembly according to claim 1, wherein the detection means comprises a coding member being at least partly encircled in the roller member.

9. A roller and push switch assembly according to claim 8, wherein the coding member comprises a metal disc having between 5 and 25 holes arranged therein, the metal disc being at least partly encircled by the roller member.

10. A roller and push switch assembly according to claim 1, wherein the detection means comprises an arrangement of an electrically conductive path arranged on a substantially plane surface, and an electrically conductive wiper having a first contact end being in contact with the electrically conductive path, the conductive wiper being arranged to rotate with the roller member whereby the first contact end is moved along the electrically conductive path upon rotation of the roller member.

11. A roller and push switch assembly according to claim 1, wherein the detection means comprises means for generating electric pulses according to a detected rotation of the roller.

* * * * *